US008075028B1

(12) United States Patent
Porter

(10) Patent No.: US 8,075,028 B1
(45) Date of Patent: Dec. 13, 2011

(54) TRASH CONTAINER LID LIFT RETAINER

(76) Inventor: Kerry Porter, Scottsdale, AZ (US)

( * ) Notice: Subject to any disclaimer, the term of this patent is extended or adjusted under 35 U.S.C. 154(b) by 1020 days.

(21) Appl. No.: 11/998,504

(22) Filed: Nov. 30, 2007

Related U.S. Application Data

(60) Provisional application No. 60/872,461, filed on Dec. 4, 2006.

(51) Int. Cl.
*E05C 17/44* (2006.01)
*E05C 17/54* (2006.01)

(52) U.S. Cl. ..... 292/338; 292/259 R; 292/339; 292/DIG. 15; 16/82; 248/200.1; 248/353

(58) Field of Classification Search ..... 292/259 R, 292/338, 339, DIG. 15; 248/200.1, 353; 296/76; 16/82
See application file for complete search history.

(56) References Cited

U.S. PATENT DOCUMENTS

| | | | | | |
|---|---|---|---|---|---|
| 2,172,178 | A | * | 9/1939 | Rosenberg | 248/118 |
| 2,434,598 | A | * | 1/1948 | Stegall | 292/339 |
| 2,490,612 | A | * | 12/1949 | Ballard | 160/225 |
| 2,618,497 | A | * | 11/1952 | Gardels | 292/265 |
| 2,973,217 | A | * | 2/1961 | Gregoire | 292/288 |
| 4,489,967 | A | * | 12/1984 | Matsui et al. | 292/339 |
| 4,584,984 | A | * | 4/1986 | Croft | 126/25 R |
| 4,676,536 | A | * | 6/1987 | Arbic et al. | 292/339 |
| 4,890,355 | A | * | 1/1990 | Schulten | 16/421 |
| 4,973,093 | A | * | 11/1990 | Olszowka | 292/339 |
| 5,228,737 | A | | 7/1993 | Zimmerman | |
| 5,595,317 | A | | 1/1997 | Hodge | |
| 5,664,520 | A | * | 9/1997 | Latimer, III | 16/421 |
| 6,029,941 | A | * | 2/2000 | Mayzes | 248/352 |
| 6,244,650 | B1 | | 6/2001 | Namvari | |
| 6,428,062 | B1 | * | 8/2002 | Roehl | 292/339 |
| 6,851,652 | B1 | * | 2/2005 | Huang | 248/200.1 |
| 2007/0007406 | A1 | * | 1/2007 | Carlson et al. | 248/200.1 |

* cited by examiner

*Primary Examiner* — Carlos Lugo

(74) *Attorney, Agent, or Firm* — Harpman & Harpman

(57) ABSTRACT

A self-contained lever device that can engage and lift and hold the lid of a large trash container open for ease of access. The lever device has oppositely disposed contoured engagement ends and an intermediate grip and deployable storage hooks can be disassembled into three sections for initial transportation prior to assembly.

4 Claims, 4 Drawing Sheets

TRASH CONTAINER LID LIFT RETAINER

This application claims benefit of U.S. Provisional Application No. 60/872,461, filed Dec. 4, 2006.

BACKGROUND OF THE INVENTION

1. Technical Field

This device relates to levers and lid retainment devices that are used to prop and hold lids and doors open by use of an elongated stick-like element with integral attachment lid engagement fittings.

2. Description of Prior Art

Prior art devices of this type have been directed to a variety of tubular stick-like elements that engage and hold lids and doors open, see for example U.S. Pat. Nos. 5,228,737, 6,244,650 and a trash container lid holder as seen in U.S. Pat. No. 5,595,317.

SUMMARY OF THE INVENTION

An elongated lid engagement and support element having an interlocking sectional shaft portion with curvilinear engagement ends extending therefrom. The engagement ends can slip under and engage a trash container lid allowing the user to lift "open" the lid and then prop it open using the oppositely disposed engagement end resting on the container itself for hands free access to the container.

DETAILED DESCRIPTION OF THE INVENTION

Figure 1:
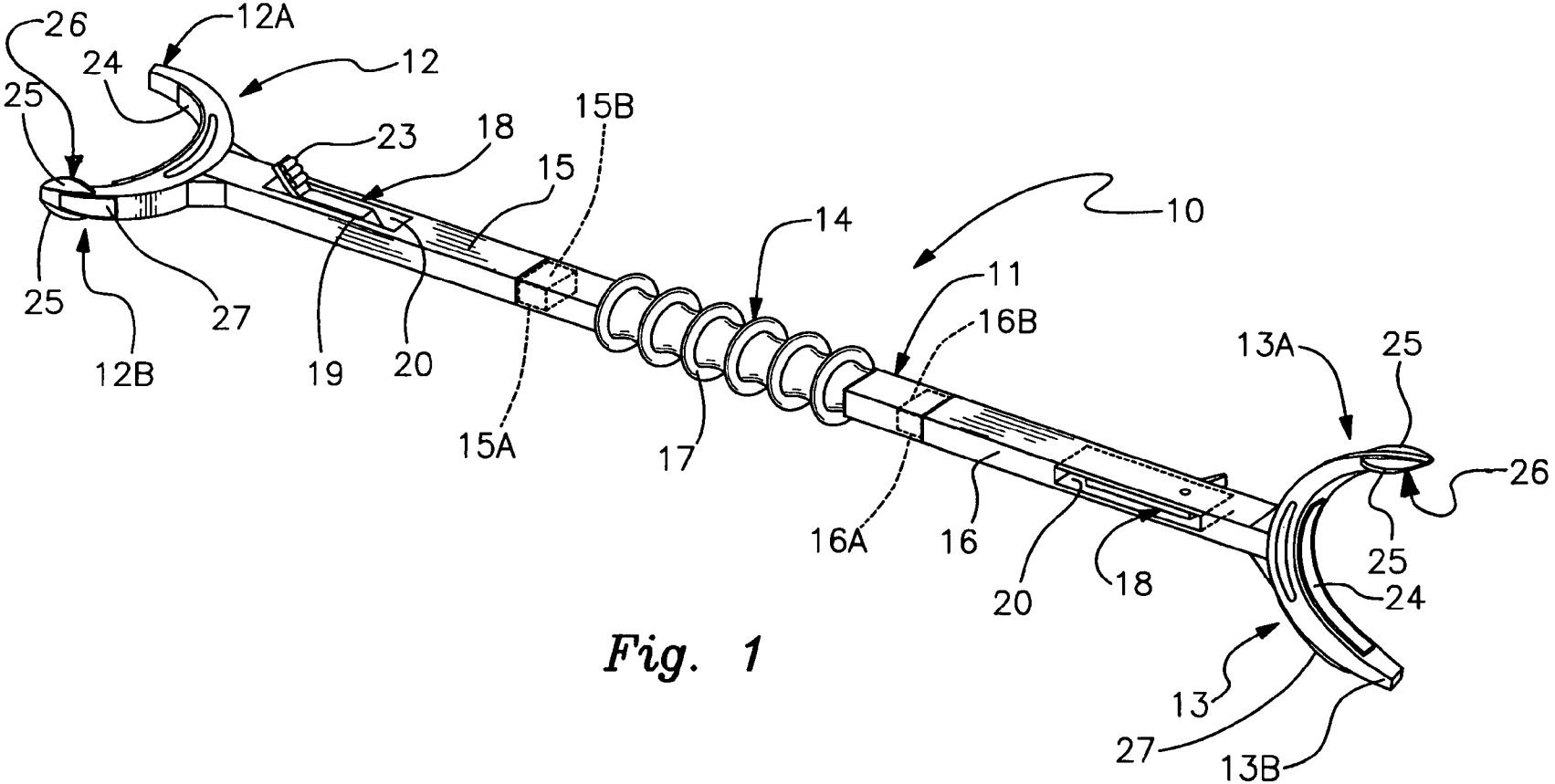
FIG. 1 is a top side perspective view of the invention in deployed assembled position.

Referring to FIGS. 1-5 of the drawings, a trash container lid lift device 10 of the invention can be seen having a main elongated body member 11 with oppositely disposed engagement surface "grips" 12 and 13 on respective free ends thereof. The body member 11 has a central portion 14 and oppositely disposed detachable end portions 15 and 16. A contoured rubberized hand grip fitting 17 is positioned on the central portion 14 as best seen in FIG. 1 of the drawings to afford ease of use.

Figure 3:
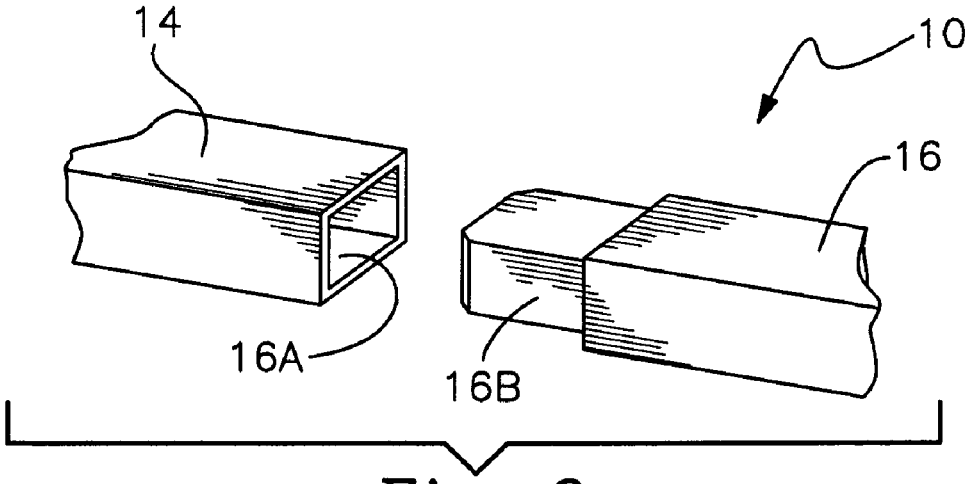
FIG. 3 is a partial exploded view illustrating interconnection thereof.
Figure 4:
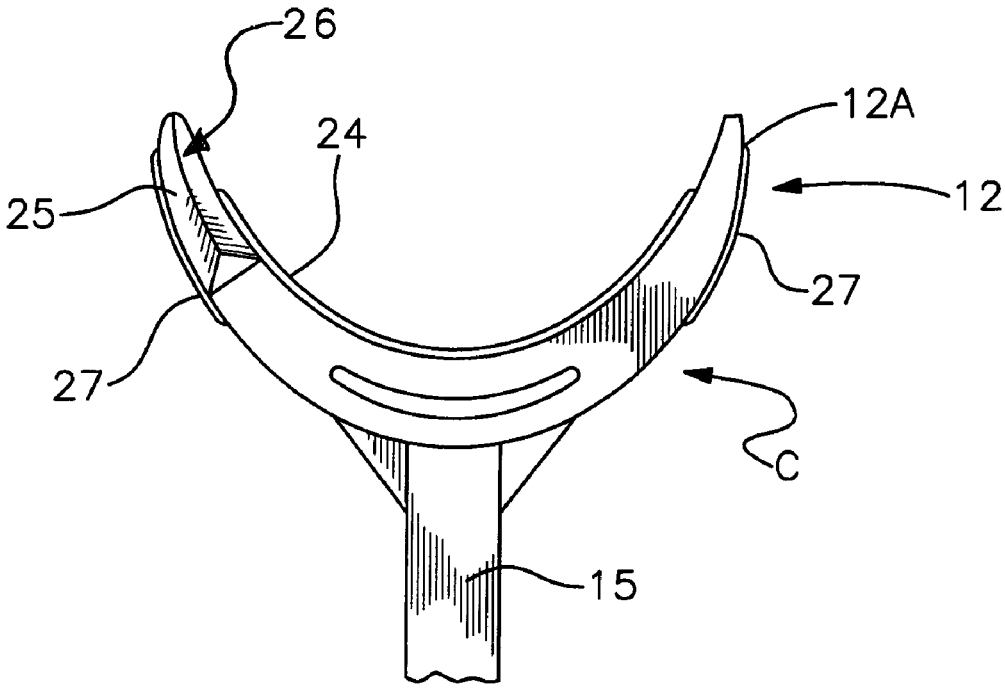
FIG. 4 is an enlarged partial side elevational view of one engagement end.

The central portion 14 has respective hollow end fittings 15A and 16A for insert registration of correspondingly configured mail end registration fittings 15B and 16B of the respective end portions 15 and 16 which interlock therein as seen in FIG. 3 of the drawings to form the extended use length of the main body member 11.

The engagement surface "grips" 12 and 13 are of a half arcuate "C" shaped configuration and extend integrally in a transverse orientation from the respective end portions 15 and 16 and are in effective translateral orientation to one another as best seen in FIG. 1 of the drawings.

Figure 2:
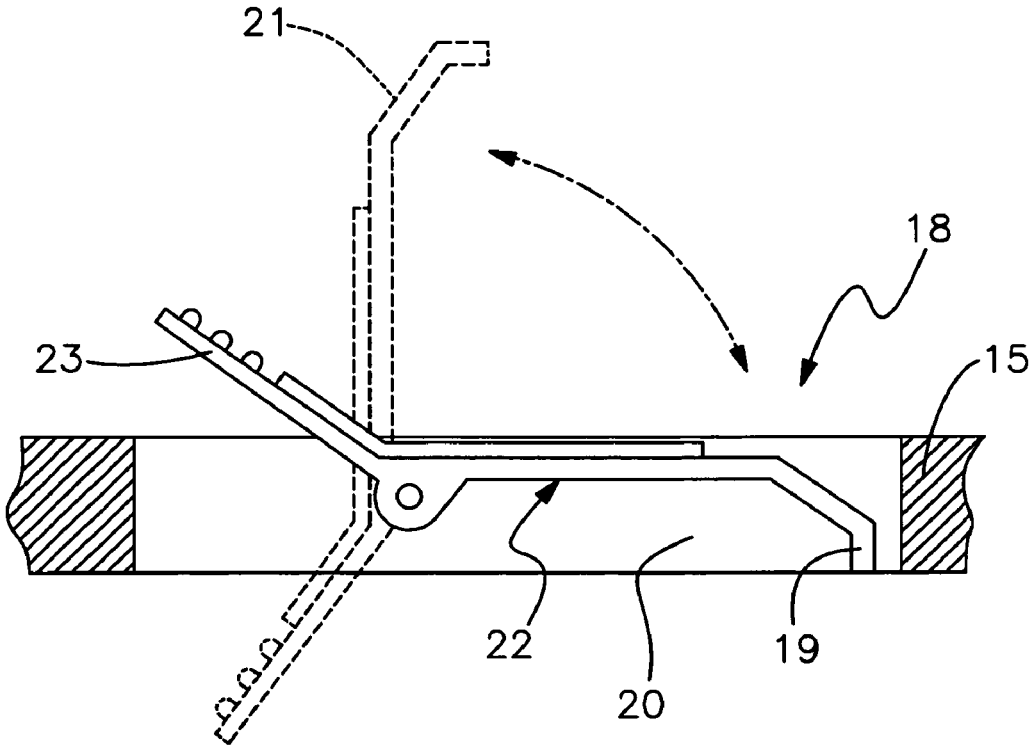
FIG. 2 is an enlarged side elevational view of the hook showing illustrative positional deployment.

A storage hook assembly 18 provides for a deployable hook 19 from within an elongated recess 20 in the respective end portions 15 and 16. The hook 19 as seen in FIG. 2 of the drawings is pivotally disposed from there within so as to selectively be deployed as illustrated in broken lines at 21 and in a non-deployment position at 22 by an activation lever 23 integral therewith. The hook 19 allows the trash container lid lift device 10 to be hung thereby for storage until use.

Each of the respective "C" shaped end engagement surface grips 12 and 13 have tapered free ends 12A and 12B and 13A and 13B with a raised insert portion of engagement material 24 of a high frictional co-efficiency therebetween. Oppositely disposed wedge extensions 25 are framed on the respective ends 12B and 13A with a rubberized end coating thereon at 26. The wedge extensions 25 are of a smooth molded material having a low frictional co-efficient to aid in the position and placement of the lid lift device 10 of the invention. Correspondingly, raised bands 27 of low frictional co-efficiency are formed on the outer side surface of the ends 12A and 12B and 13A and 13B to provide ease of lid (not shown) engagement as will be evident to those skilled in the art during use.

Figure 5:
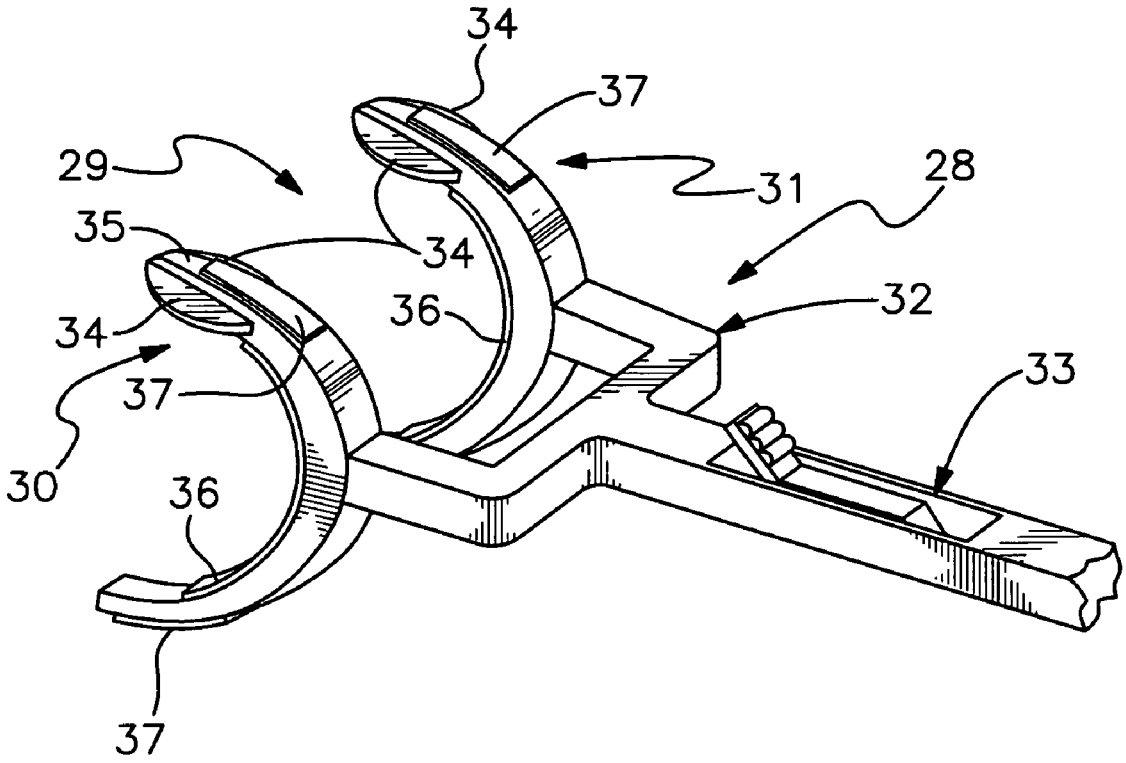
FIG. 5 is an enlarged partial perspective view of an alternate form of the invention.

Referring now to FIG. 5 of the drawings, an alternate form of the invention can be seen at 28 in which a modified end grip portion 29 is illustrated. The end grip portion 29 has a pair of "C" shaped aligned parallel half arcuate end configurations 30 and 31 mounted on a bifurcated bracket 32 on an end portion 33. The modified end grip portion 29 has identical engagement features as hereinbefore described with corresponding oppositely disposed wedge extensions 34, rubberized end coating at 35 and insert portions 36 with raised bands 37 of low friction co-efficiency on their outer surfaces. The modified grip portions 29 engaging the container, holding the lid open for ease of access as set forth in the preferred embodiment hereinbefore described.

It will be evident to those skilled in the art that the lid lift device 10 and 25 of the invention is particularly suited for use with large commercial or residential type trash containers which have hinged lids which are difficult to hold open and simultaneously insert trash within by the user. Such a device of the invention provides a simple, safe and effective utilization entity that can provide for the simplified and safe support of trash container lids without blocking the access entrance to the container for insertion of trash.

It will be apparent to those skilled in the art that various changes and modifications may be made therein without departing from the spirit of the invention.

Therefore I claim:

1. A lid lift retainer device for a trash container comprises, an elongated rod member having a detachable center grip engagement portion, oppositely disposed end extending portions, storage hook assemblies each deployable from within said respective end portions for hanging up said lid lift retainer when not in use, said hook assemblies comprising on elongated member having oppositely disposed angular offset portions secured within respective openings extending through said respective end portions for deployment therefrom, bifurcated work engagement elements on said end portions, said work engagement elements having contoured tapered end portion extending surfaces for engagement with a lid and said trash container respectively, said work engagement elements have raised inserts therebetween for non-slip engagement with said lid, means for interengaging said center grip engagement portion with said respective end engagement portions.

2. The lid lift retainer device set forth in claim 1 wherein said detachable center grip engagement portion has a resilient contoured engagement cover there around.

3. The lid lift retainer device set forth in claim 1 wherein said means for interengaging said contoured grip portion with said respective end engagement portion comprises, registering end fittings on said respective adjoining ends thereof.

4. The lid lift retaining device set forth in claim 1 wherein said elongated pivoted member is movable from a first longitudinal aligned recessed position within said respective end portions to a second right angularly oppositely disposed extending position.

* * * * *